US005990769A

United States Patent [19]

Tam

[11] Patent Number: 5,990,769

[45] Date of Patent: Nov. 23, 1999

[54] SWITCHABLE ELECTRIC OUTLET ADAPTOR

[76] Inventor: Clement Pui-Yin Tam, Unit 4, 395 Harry Walker Parkway, Newmarket, Ontario, Canada, L3Y 7B3

[21] Appl. No.: 08/956,392

[22] Filed: Oct. 23, 1997

[51] Int. Cl.[6] ..... H01H 73/00

[52] U.S. Cl. ..... 335/18; 335/202

[58] Field of Search ..... 335/18, 167–76, 335/202; 361/42–49

[56] References Cited

U.S. PATENT DOCUMENTS 4,595,894 6/1986 Doyle et al. ..... 335/18
4,719,437 1/1988 Yun ..... 335/18
4,816,957 3/1989 Irwin ..... 361/45
5,644,464 7/1997 Zhou ..... 361/115

*Primary Examiner*—Lincoln Donovan
*Attorney, Agent, or Firm*—Ridout & Maybee

[57] ABSTRACT

A switchable adaptor for receptacles includes a manually settable switch that may be manually tripped or tripped by a solenoid in response to a signal. The switch is readily converted to be normally ON or normally OFF, and to be unipolar or multipolar. The adaptor may conveniently be in the form of a power bar or a power block, and will normally include a circuit board which may incorporate a circuit suitable for generating a signal responsive to a predetermined input condition.

13 Claims, 5 Drawing Sheets

SWITCHABLE ELECTRIC OUTLET ADAPTOR

FIELD OF THE INVENTION

This invention relates to an electrical switching device; it relates more particularly to a device that may be connected to a convenience receptacle to provide a switched output, wherein the switch is responsive to a predetermined signal.

BACKGROUND OF THE INVENTION

It is well known to provide adaptors for convenience receptacles. Such adaptors may connect to the receptacle through a flexible cord, for example power bars, or they may plug into the receptacle to be supported therefrom. Commonly, the receptacle to which the adaptor is connected is a duplex receptacle, and the adaptor may serve to increase the number of outputs.

It is also well known to provide adaptors with a switching capability. Examples of such switching capability include overload cutouts, noise activated switches, sound activated switches, and timer switchers. The switches of the above adaptors usually differ in their nature whereby it is not possible to provide a base unit which can be readily modified according to particular circumstances. Such switches are also usually monopolar, and are not easily modified to provide multipolar switching.

Many of the switches cannot be manually actuated so as to toggle the switch between a set and reset state as desired.

It is primary object of this invention to provide a switchable adaptor unit wherein the switch is readily modified so as to be controllable by different types of signal.

It is further object of this invention to provide switchable adaptor units of the foregoing nature that are readily modified to be monopolar or multipolar.

It is a still further object of this invention to provide adaptor units of the foregoing nature wherein the switch is manually actuatable to toggle the units between two different states as desired.

SUMMARY OF THE INVENTION

In accordance with a broad aspect of the invention, an adaptor unit for use with an electrical receptacle to provide a switched output therefrom in response to a signal comprises an insulating housing and means extending from the housing to engage with an electrical receptacle, which means terminates in a line terminal and a return line terminal within the housing. The housing has a plurality of prong openings, at least two of the openings being respectively associated with a line electrode and a return line electrode. A first pair of switch contacts is electrically connected respectively to the line terminal and the line electrode, at least one of the contacts being connected to one of the line terminal and the line terminal electrode by a leaf spring; an actuator is mounted in the housing for movement between a first position, wherein the actuator urges the first pair of switch contacts into a first electrical state, and a second position wherein the first pair of switch contacts are in a second electrical state, with the leaf spring urging the actuator towards its second position. A conditioner is mounted within the housing for movement between the first and second position, and spring means is provided to bias the conditioner towards its first position. Latch means is provided which serves to latch the conditioner to the actuator when the conditioner is urged under manual pressure to its second position; release of the manual pressure permitting the conditioner to return to its first position under the influence of the bias spring means, and to entrain the actuator to its first position. Solenoid means is further provided within the housing which is responsive to a signal acting to trip the latch to disengage the conditioner therefrom, thereby permitting the actuator to revert to its second position and concomitantly, the first pair of switch contacts to revert to their second electrical state.

Suitably, the solenoid is mounted from a circuit board which may include known types of circuit means to provide a controlling output for the solenoid in response to a signal.

The solenoid may suitably be arranged to trip the latch upon its energization, or it may be arranged to trip the latch upon its de-energization.

The contacts in their second state may be open, with the actuator serving to close the contacts when the conditioner is set in its first position; alternatively the contacts when in their second state may be closed, and the conditioner when set to its first position will serve to open the contacts.

Suitably, manual means is provided to trip the latch means to permit the actuator to reset to its second position.

A second pair of switch contacts electrically connected respectively to the return line terminal and the return line electrode may be provided, at least one of the second pair of contacts being connected to one of the return line terminal and the terminal line electrode by a second leaf spring, the second leaf spring urging the contact towards its second position, whereby the actuator when in its first position serves to urge the second switch contacts into the same electrical state as the first pair of switch contacts.

Suitably and preferably, each of the first pair of switch contacts, and the second pair of switch contacts if provided, is mounted from a leaf spring.

Also suitably, a visual means is provided for mechanically indicating the state of operation of the switch means, i.e. whether the switch contacts are set in their first position or reset to their second position. Means may also be provided for indicating electrically the presence of power at the switched outlet.

In accordance with another aspect of the invention, the housing includes a plurality of prong openings therethrough, each group of prong openings being configured to receive the prongs of the standard electrical plug therein; a prong electrode assembly comprising an insulating holder is retained within the housing to underlay the prong openings, the holder having a plurality of channels therein aligned with the longitudinal axis of the housing. A line strip electrode and a return line strip electrode are disposed in respective ones of the channels to underlay respective ones of the prong opening in the housing, so as to be contacted by prongs inserted through the openings. Suitably, the circuit board may be carried by the insulating holder. Also suitably, the circuit board provides an electrical path between the contacts and the electrodes.

The invention will be further described in relation to a preferred embodiment thereof as illustrated in the accompanying drawings.

DESCRIPTION OF THE PREFERRED EMBODIMENT

Figure 1:
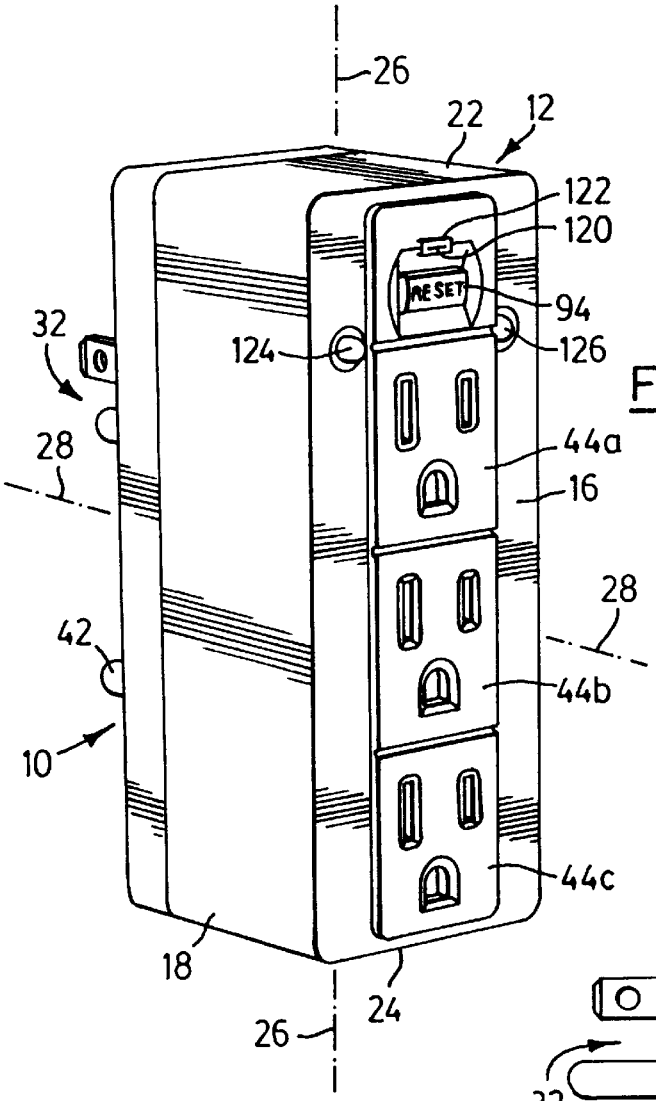
FIG. 1 shows the adaptor unit of the invention in frontal perspective view.
Figure 3:
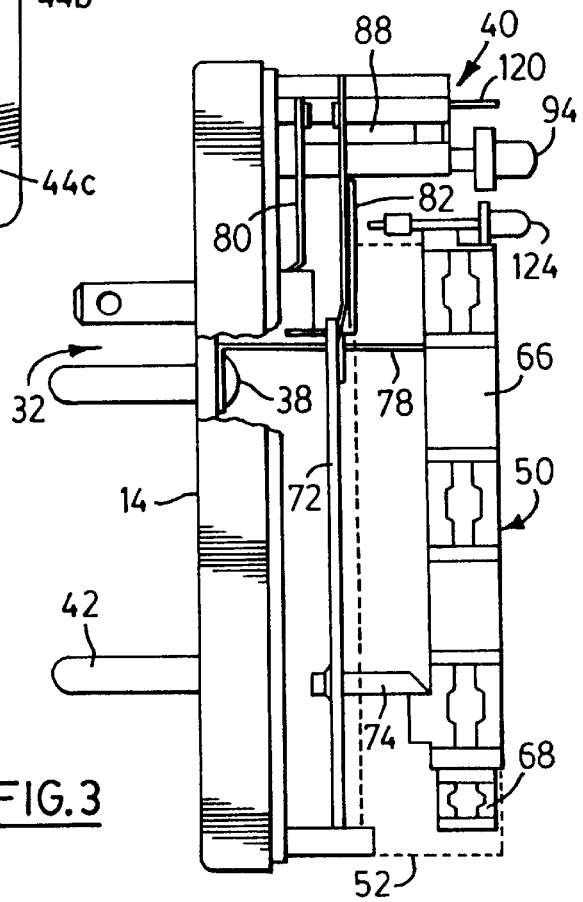
FIG. 3 shows the adaptor unit of FIG. 1 in side elevation, with the cover removed, and with the electrode carrier portion shown in dashed outline, partially cut away to reveal details of construction.
Figure 2:
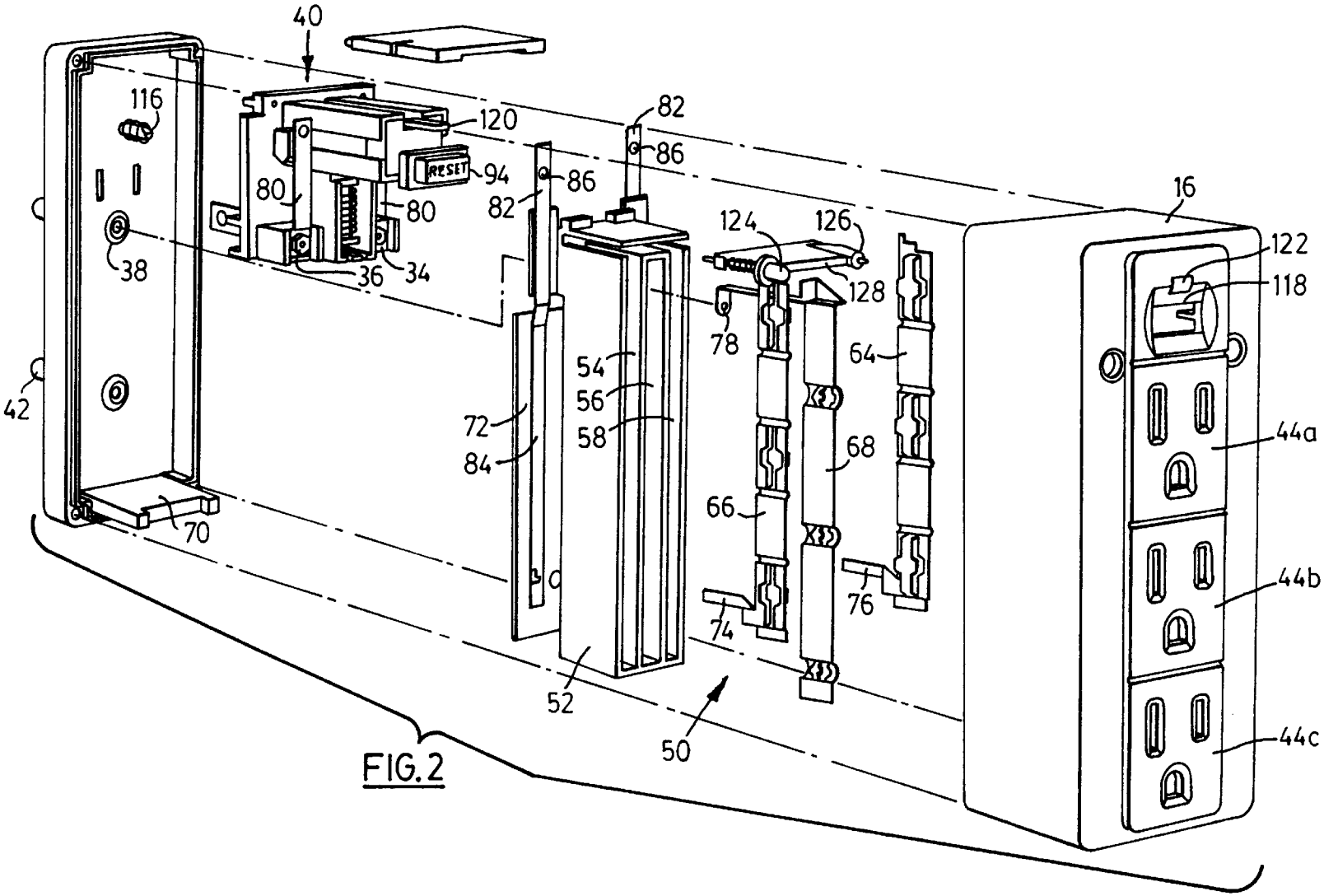
FIG. 2 shows the adaptor unit of FIG. 1 in exploded, perspective, frontal view to reveal the interior thereof.
Figure 4:
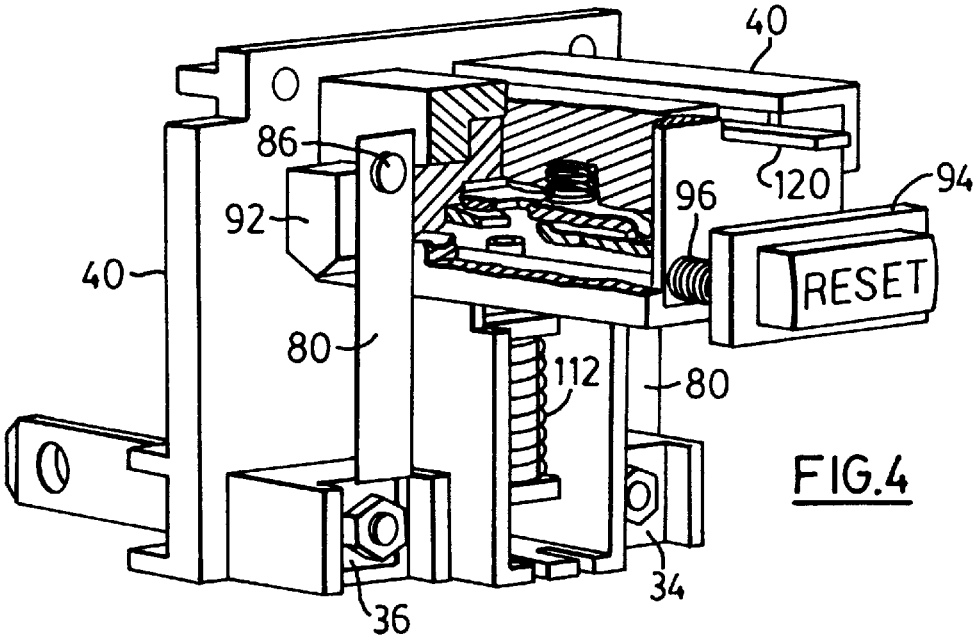
FIG. 4 shows in assembled, cut away form the manual switch actuator of the unit of FIG. 1.
Figure 5:
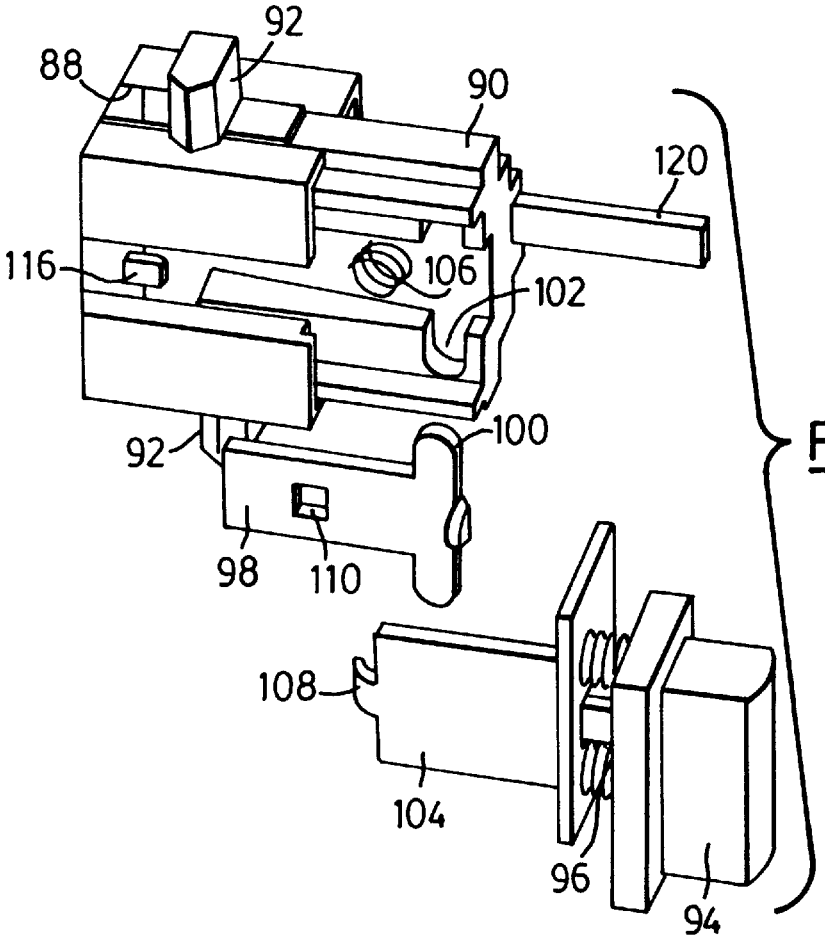
FIG. 5 shows in exploded, perspective view the switch actuator of FIG. 4.

Referring to the drawings in detail, an adaptor unit of a plug-in type in accordance with the invention is identified generally therein by the numeral 10. Unit 10 comprises an insulating housing 12 including a reverse face 14, a cover 16 comprising side walls 18, and obverse face 20, top wall 22 and bottom wall 24. A longitudinal axis 26 extends between top wall 22 and bottom wall 24, and a transfer axis 28 extends between reverse face 14 and obverse face 20.

A plurality of prongs 32 extends rearwardly from reverse face 14, configured to engage in a standard receptacle outlet (not shown), which prongs terminate within housing 12 in a line terminal 34 and a return line terminal 36, and the ground terminal 38. The line terminal 34 and return line terminal 36 are carried on an insulating switch block 40 disposed within housing 12. A dummy ground prong 42 projects rearwardly from the base 14, positioned to engage in a lower ground socket opening of a duplex receptacle outlet (not shown) when prongs 32 engage in an upper outlet thereof, so as to physically stabilize interconnection between the duplex receptacle and adaptor unit 10. Housing 12 is provided on obverse face 20 thereof with three pluralities of groups of openings 44A, 44B, 44C, each of which plurality is configured as a standard convenience outlet. A prong electrode assembly 50 underlays openings 44A–44C, which assembly comprises an insulating holder 52 having three axially aligned channels 54, 56, 58 therein, within which there is respectively located a line strip electrode 64, a return line strip electrode 66, and a ground strip electrode 68. Assembly 50 is rigidly supported within housing 12 by a spacer 70 adjacent bottom wall 24, while the upper end of holder 52 bears upon insulating switch block 40, whereby strips 64, 66, 68 underlay the respective prong openings of groups 44A, 44B, 44C A circuit board 72 underlays holder 52.

Strip electrodes 64, 66 and 68 are each provided with a leg formed unitarily therewith, which legs are respectively identified by the numerals 74, 76, 78, with legs 74, 76 being connected to circuit board 72, and leg 78 to ground terminal 38, in electrically conducting relationship.

A first pair of leaf springs 80 are respectively supported from line terminal 34 and return line terminal 36 in upstanding relationship; a second pair of leaf springs are 82 supported from circuit board 72 in opposed spaced apart relationship with the first pair of springs, the second pair of springs being respectively connected to line strip electrode 64 and return line strip electrode 66 by conductors 86 on circuit board 72. A contact 86 is disposed adjacent the distal end of each leaf spring of the pairs of leaf springs 80, 82 which contacts in the relaxed condition of the leaf springs are normally open.

Switch block 40 is provided with a track 88 therein axially aligned with the transverse axis 28. An actuator 90 is mounted for sliding movement along track 88 between first and second positions. Actuator 90 includes a pair of shoulders 92 which respectively project on opposed lateral sides of switch block 40, which shoulders are disposed rearwardly of the first pair of leaf springs 80, whereby when the actuator is moved to its first position against the bias of leaf springs 80, the first pair of leaf springs will be urged towards the second pair of leaf springs 82, and close contacts 86, thereby interconnecting line terminal 34 with line strip electrode 64, and return line terminal 36 with return line strip electrode 66. When actuator 90 is released from its first position, it will move under the influence of leaf springs 80 to its second position. Actuator 90 is moved to its first position by a conditioner 94 which is mounted from switch block 40 for sliding movement parallel to the travel of actuator 90 between a first position and a second position, with coil springs 96 biasing the conditioner to its first position. A latch plate 98 is hinged to actuator 90 by ears 100 which are received in recesses 102 provided in actuator 90. Conditioner 94 comprises a tab portion 104 which underlays latch plate 98, and a spring 96 biases the latch plate towards the tab portion. The tab portion 104 is provided with a hook 108 adjacent its distal end, and the latch plate 98 is provided with an opening 110 therein.

Figure 6A:
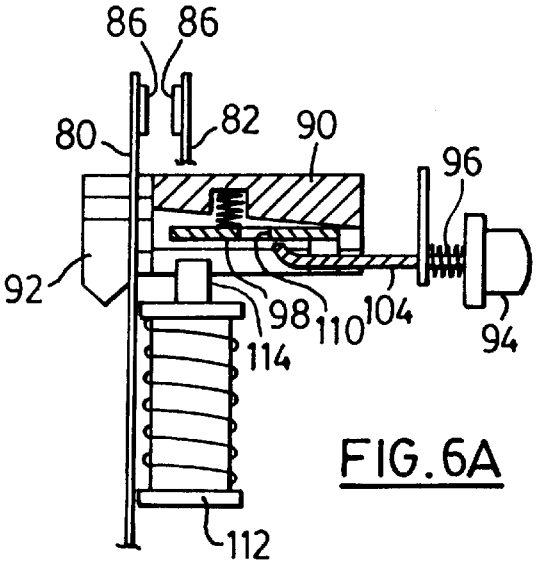
FIGS. 6A–6D show in schematic form the operation of the switch actuator of FIG. 4.
Figure 6B:
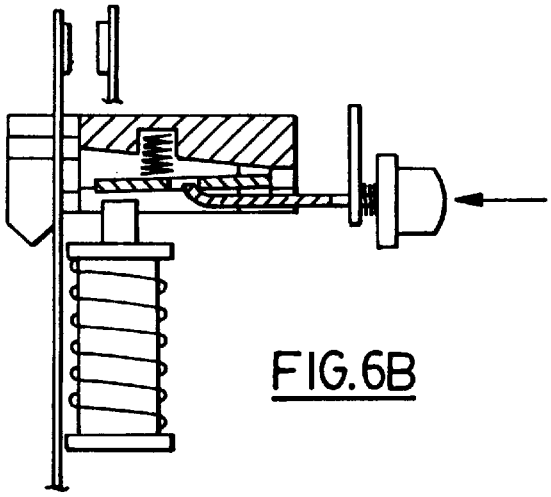
Figure 6C:
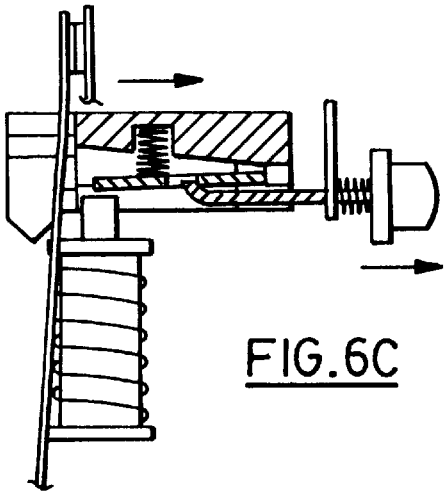

The switching action of the assembly as thus far described can best be appreciated from a consideration of FIGS. 6A–6D. As seen in FIG. 6A, conditioner 94 is biased to its first (forward) position by spring 96, actuator 90 is biased to its second position by leaf spring 80, and latch plate 98 is biased towards the tab portion 104 of the conditioner. As seen in FIG. 6B, a manual pressure applied to conditioner 94 urges the conditioner to its second position, causing hook 108 to latch into opening 110. As seen in FIG. 6C, the release of manual pressure from conditioner 94 causes the conditioner to revert to its first position under the influence of spring 96, and entrain actuator 90 to its first position, thereby closing contact 86.

Figure 6D:
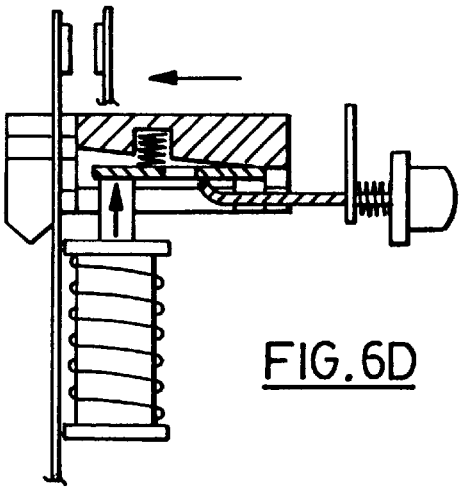

A solenoid 112 is mounted to switch block 40, operatively connected to circuit board 72. Solenoid 112 has a plunger 114 which is biased inwardly, with excitation of the solenoid serving to move the plunger outwardly. As best seen in FIG. 6D, the outward movement of plunger 114 brings it into contact with latch plate 98, to urge the latch plate against the bias of spring 106, thereby causing the latch plate to unlatch from conditioner 94, and permit the return of actuator 90 to its second position and so open contacts 86.

Figure 7B:
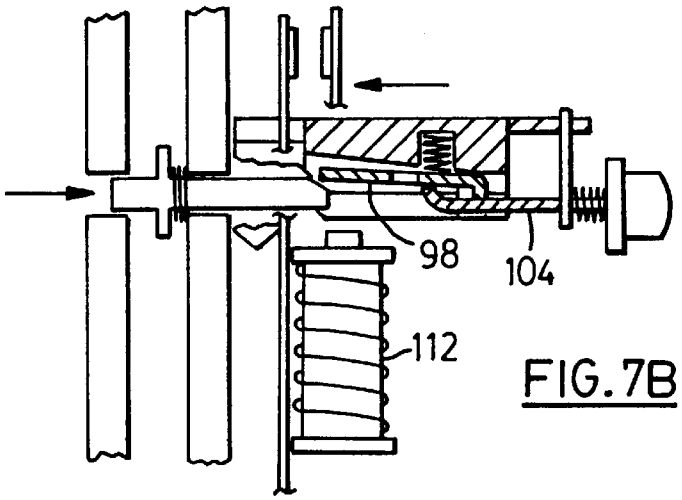
FIGS. 7A-7B are similar to FIGS. 6C and 6D, but show in schematic form a manual resetting of the switch actuator.
Figure 7A:
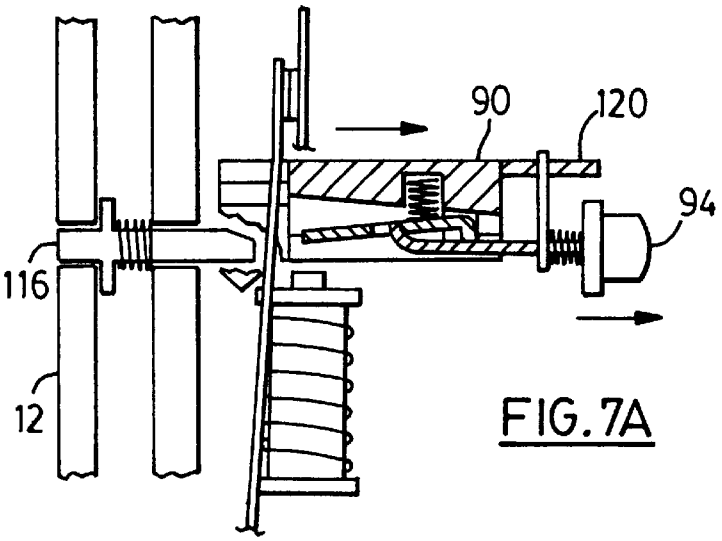
Figure 8:
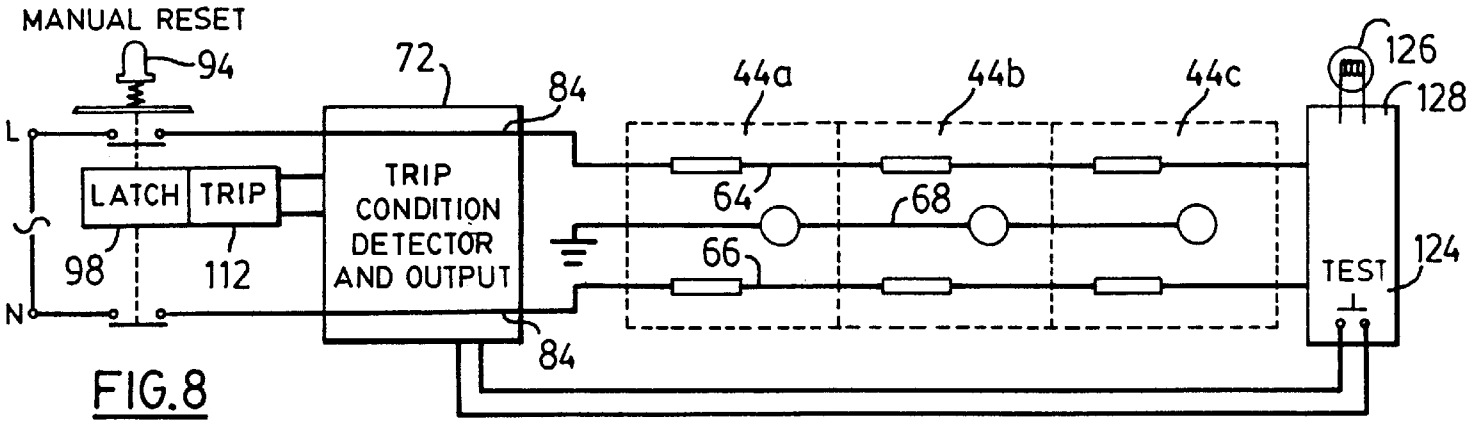
FIG. 8 shows in schematic form the electrical circuit of the unit of FIG. 1.

Latch plate 98 may be tripped manually should this be desired by means of a trip finger 116, the action of which is illustrated in FIG. 7A and 7B.

Housing 12 includes in obverse face 20 a window opening 118 therethrough to provide access to conditioner 94 for the actuation thereof. It will be appreciated that the state of contacts 86, i.e. whether closed or open, cannot be predicted from the state of conditioner 94. Conveniently, a switch indicator 120 is mounted to actuator 90 to project forwardly therefrom through opening 122 in the obverse face of housing 16, to provide a visual indication of the state of the switch contacts 86.

Circuit board 72 will normally include circuit means (not shown) as is generally known in the art for detecting a trip condition and providing a trip output suitable for the actuation of solenoid 112 responsive to an input signal from a transducer (not shown) or from an otherwise detected condition, for example a ground fault condition, such as is disclosed in U.S. Patent. Unit 10 as illustrated is particularly adapted for use in the ground fault application by the provision of a test switch 124, which serves to simulate ground fault, and an indicator lamp 126, which provides a visual indication of the presence of an operational line voltage across the line and return line electrodes 64, 66. Conveniently, test switch 124 and lamp 126 are mounted from a subsidiary circuit board 128.

It will be understood that adaptor unit 10 may be easily modified whereby actuator 90 serves to set contact 84 to an open condition when at second position, or to set one pair of contacts open and one pair closed, for example, and that further pairs of contacts may be provided should it be desired to increase the number of switching circuits. Many other obvious changes to the illustrative embodiments may be made, and it is intended that these fall within the scope of the invention that is claimed.

I claim:

1. An adaptor unit for use with a duplex electrical receptacle to provide a switched output therefrom responsive to a signal, comprising:

a hollow, generally rectangular prismatic housing including an obverse face, a reverse face, top wall, bottom wall and side walls, said housing having a longitudinal axis intersecting said top and bottom walls and a transverse axis intersecting said obverse and reverse faces;

said obverse face having a plurality of groups of prong openings therethrough, each group of prong openings being configured to receive the prongs of a standard electrical plug therein;

means extending from said housing to engage with an electric receptacle, said means terminating within said housing at a line terminal and a return line terminal;

a prong electrode assembly comprising an insulating holder retained in said housing, said holder having a plurality of channels therein aligned with said longitudinal axis;

a line strip electrode and a return line strip electrode disposed in respective ones of said channels to underlay respective ones of said prong openings of said groups of prong openings, each of said strip electrodes having respective lead ends;

circuit means having contact points for contacting the respective lead ends and electrically coupling said respective strip electrodes and including a first switch interconnecting said line terminal and said line strip electrode;

manually settable means to latch said first switch to a first condition; and a solenoid responsive to the receipt of a signal to unlatch said first switch to permit to revert to a second condition.

2. An adaptor unit as defined in claim 1 wherein manual means is provided to unlatch said switch.

3. An adaptor unit as defined in claim 1 wherein said switch comprises a pair of switch contacts, at least one of which is mounted from a leaf spring, and said manually operable settable means includes a switch conditioner mounted within said housing for movement between first and second positions;

spring means biasing said conditioner towards said first position;

latch means serving to latchingly engage said conditioner to said actuator when said conditioner is urged under manual pressure to its second position;

release of said manual pressures causing said conditioner to return to its first position under the influence of said bias spring means, and to entrain said actuator to its first position;

said solenoid means responsive to said signal acting to trip said latch to disengage said conditioner therefrom, thereby permitting said actuator to revert to its second position so as to permit said first pair of switch contacts to revert to their second condition.

4. An adaptor unit as defined in claim 3 wherein each of said pair of switch contacts is mounted on a leaf spring.

5. An adaptor unit as defined in claim 1 including a second switch interconnecting said return line terminal and said return line strip electrode in parallel with said first switch, for movement between first and second conditions, and wherein said manually settable means acts on said second switch in an identical manner to said first switch.

6. An adaptor unit as defined in claim 1 wherein said first switch when in its second condition is open.

7. An adaptor unit as defined in claim 5 wherein said first and second switches when in their second condition are open.

8. An adaptor unit as defined in claim 1 wherein mechanical means is provided to provide a visual indication externally of said housing of the position of said actuator.

9. A adaptor unit as defined in claim 1 wherein said means extending from said housing comprises a plurality of prongs mounted from said reverse face to extend rearwardly therefrom.

10. The adapter unit as defined in claim 1, further including means for mounting said circuit means adjacent to and proximate said insulating holder, and each of said channels in said insulating holder for said line strip electrode and said return line strip electrode including an opening for the respective lead end on each of said strip electrodes, said openings being in communication with the respective contact point on said circuit means.

11. The adapter unit as defined in claim 1, further including subsidiary circuit means, each of said line strip and said return line strip electrodes having second lead ends for electrically coupling to respective contact points on said subsidiary circuit means, and said insulating holder including a slot for mounting said subsidiary circuit means.

12. The adapter unit as defined in claim 11, wherein said subsidiary circuit means includes circuit means for testing the unit, and means for indicating a power on state for the unit, said means for testing being responsive to manual actuation.

13. The adapter unit as defined in claim 1, further including means for manually actuating said first switch to said second condition state.

* * * * *